US011357692B2

(12) United States Patent
Terada et al.

(10) Patent No.: US 11,357,692 B2
(45) Date of Patent: Jun. 14, 2022

(54) JOINT SUPPORT UNIT AND WALKING SUPPORT APPARATUS

(71) Applicants: UNIVERSITY OF YAMANASHI, Kofu (JP); KOFU CITY, Kofu (JP); SUNCALL CORPORATION, Kyoto (JP)

(72) Inventors: Hidetsugu Terada, Kofu (JP); Koji Makino, Kofu (JP); Teppei Ogura, Kofu (JP); Masahiro Nakamura, Kofu (JP); Rei Takahashi, Kyoto (JP); Masaru Hoshino, Tokyo (JP); Yukinobu Makihara, Tokyo (JP)

(73) Assignees: University of Yamanashi, Yamanashi (JP); Kofu City, Yamanashi (JP); Suncall Corporation, Kyoto (JP)

( * ) Notice: Subject to any disclaimer, the term of this patent is extended or adjusted under 35 U.S.C. 154(b) by 15 days.

(21) Appl. No.: 16/957,452

(22) PCT Filed: Dec. 12, 2018

(86) PCT No.: PCT/JP2018/045759
§ 371 (c)(1),
(2) Date: Jun. 24, 2020

(87) PCT Pub. No.: WO2019/131152
PCT Pub. Date: Jul. 4, 2019

(65) Prior Publication Data

US 2021/0069053 A1 Mar. 11, 2021

(30) Foreign Application Priority Data

Dec. 25, 2017 (JP) ..... JP2017-248375

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 2003/007* (2013.01);
(Continued)

(58) Field of Classification Search
CPC ..... A61H 3/00; A61H 1/0262; A61H 2003/007; A61H 2201/1207;
(Continued)

(56) References Cited

U.S. PATENT DOCUMENTS

2015/0313786 A1* 11/2015 Sano ..... A61H 1/0255 602/16
2017/0360646 A1* 12/2017 Poli ..... A61H 1/0255
(Continued)

FOREIGN PATENT DOCUMENTS

JP 4092322 B2 5/2008
JP 2012-165823 A 9/2012
JP 5713388 B2 5/2015

OTHER PUBLICATIONS

International Search Report dated Feb. 12, 2019, issued for PCT/JP2018/045759.

*Primary Examiner* — Jerrah Edwards
*Assistant Examiner* — Aren Patel
(74) *Attorney, Agent, or Firm* — Locke Lord LLP

(57) ABSTRACT

To provide a joint support unit, etc. capable of being worn on both left and right joints. A joint support unit 20 includes a first link 21 worn on one end side of a knee joint, a second link 22 worn on the other end side of the knee joint, and a driving unit 30 configured to cause the first link 21 and the second link 22 to perform rotational movement, or to relatively perform rotational movement while moving a rotation center and to perform sliding movement.

9 Claims, 8 Drawing Sheets

(52) U.S. Cl.
CPC ..... *A61H 2201/1207* (2013.01); *A61H 2201/163* (2013.01); *A61H 2201/1642* (2013.01); *A61H 2201/1652* (2013.01)

(58) Field of Classification Search
CPC ..... A61H 2201/163; A61H 2201/1642; A61H 2201/1652
See application file for complete search history.

(56) References Cited

U.S. PATENT DOCUMENTS

| | | | | |
|---|---|---|---|---|
| 2018/0161188 | A1* | 6/2018 | Zistatsis | A61H 3/008 |
| 2018/0281704 | A1* | 10/2018 | Sharma | B60R 13/043 |
| 2020/0069505 | A1* | 3/2020 | Fujita | A61H 3/00 |

* cited by examiner

JOINT SUPPORT UNIT AND WALKING SUPPORT APPARATUS

TECHNICAL FIELD

The present invention relates to a joint support unit, etc. for supporting the movement of a joint of a user.

BACKGROUND ART

Walking support apparatuses have been conventionally known that are used for supporting walking exercise, bending and stretching motion, rehabilitation, etc. of a patient who had suffered from worsening symptoms of knee osteoarthritis, and who had artificial knee joint replacement, etc. There are a plurality of walking support apparatuses of this kind (for example, see Patent Literature 1), and the walking support apparatus illustrated in Patent Literature 1 is provided with a joint support unit that is worn on a knee joint of a user, and that includes a leg link for oscillating around the knee joint and its vicinity in the front and back directions by using an actuator.

A knee joint of a human body is constituted by a bone portion formed by a femur, a tibia, and a patella, a cartilage formed by a meniscus, and ligaments such as an anterior cruciate ligament, a posterior cruciate ligament, a medial collateral ligament, and a lateral collateral ligament.

As shown in FIG. 7, the lower portion of a femur 1 is protruding backward, and has a shape of combination of several arcs having different sizes. The upper surface of a tibia 2 is substantially flat, and the bending and stretching motion of a knee is performed when the lower portion of the femur 1 is rotated while being slid on this upper surface.

FIG. 8 shows a track drawn by a rotation center 2*a* of the lower portion of the femur 1 along with the bending and stretching motion of a knee. As is clear from FIG. 8, when a knee joint is bent and stretched, the rotation center 2*a* of the lower portion of the femur 1 draws a curved track while being shifted. In this manner, the knee joint does not perform a mere rotational movement, but performs sliding and rotating movement.

Additionally, FIG. 7 shows an example of the relationship between the angle of the knee joint and a sliding amount. In FIG. 7, bending angles U, V and W of the knee joint correspond to sliding amounts u, v and w, respectively. Assuming that the state where the knee is stretched is of 0 degree, the range of movement of the bending and stretching motion of the knee joint 1 is about 0 to 130 degrees, and the range of movement used at the time of walking is about 0 to 60 degrees. In this range of movement, a rolling motion about substantially one axis is performed from the beginning of bending of the knee to 10 to 15 degrees, then is gradually shifted to a sliding movement, and becomes sliding and rotating movement.

Conventionally, considering such sliding and rotating movement of a knee joint, a knee joint movement support apparatus has been proposed in which a knee joint side end portion of a lower leg wearing portion is slid in front and back directions, when the lower leg wearing portion worn on a lower leg portion of a human body is rotated with respect to an upper leg wearing portion worn on an upper leg portion of the human body (for example, see Patent Literature 2). According to this knee joint movement support apparatus, it is possible to increase the followability to knee joint movement of a human being, and thus to prevent shifting of a harness, and to solve the wearing discomfort, etc.

The knee joint movement support apparatus described in Patent Literature 2 includes a coupling unit that can move an pivot axis (rotation center), and a driving unit that includes a cam mechanism performing a sliding motion between knee joint ends, and causes the pivot axis to perform a sliding motion between the knee joint ends while properly moving and controlling the pivot axis at a predetermined angle.

CITATION LIST

Patent Literature

Patent Literature 1: Japanese Patent No. 4092322
Patent Literature 2: Japanese Patent No. 5713388

SUMMARY OF INVENTION

Technical Problem

In such a knee joint movement support apparatus, since the driving directions are different when worn on left and right legs, it is necessary to separately manufacture exclusive apparatuses for left and right legs, which has been a factor for increasing the cost.

Additionally, although it was examined whether or not an apparatus capable of being used for both left and right can be manufactured by improving the knee joint movement support apparatus illustrated in Patent Literature 2, it was necessary to have a configuration that performs a predetermined operation without using the coupling unit.

Also, generally, a walking support apparatus is manufactured and sold as a pair of left and right walking support units, and it has been necessary for a purchaser to purchase both left and right walking support units, even if only one side of the walking support units is required.

On the other hand, when a joint support unit provided in a walking support unit can be used for both left and right, the joint support unit is versatile and can easily reduce the cost.

Therefore, the present invention has been made while taking the above-described issue as an example of the problem, and aims at providing a joint support unit, etc. capable of being worn on both left and right joints.

Solution to Problem

In order to solve the above-described problem, the present invention adopts the following configurations. Note that in order to facilitate understanding of the present invention, the reference numerals in the drawings are written with parentheses in the description, but the present invention is not limited to this.

Specifically, a joint support unit (20) according to claim 1 is characterized by including a first link (21) worn on one end side of a knee joint, a second link (22) worn on the other end side of the knee joint, and a driving unit (30) configured to cause the first link and the second link to perform rotational movement between the first link and the second link, or to relatively perform rotational movement while moving a rotation center and to perform sliding movement, the driving unit including a periphery cam (32), a driver (33) configured to move around a periphery of the periphery cam, a first cam groove (41) formed inside the periphery cam, a second cam groove (45) arranged inside the first cam groove, and formed asymmetrically to the first cam groove, a first cam pin (42) engaging with the first cam groove, and a second cam pin (46) engaging with the second cam groove, wherein at least the first cam pin or the second cam pin is moved while being engaged with the first cam groove or the second cam groove by movement of the driver.

Additionally, the joint support unit according to claim 2 is characterized in that, in the joint support unit according to claim 1, in the first cam groove and the second cam groove, the first cam pin and the second cam pin are movable to correspond to different driving directions generated between the first link and the second link, on the basis of a stretched state of the first link and the second link.

Additionally, the joint support unit according to claim 3 is characterized in that, in the joint support unit according to claim 1 or 2, an internal angle (α) at which respective perpendicular lines perpendicularly crossing straight lines connecting the rotation center and the respective two cam pins and passing through the respective cam pins are crossed in a stretched state of the first link and the second link is at least 30 degree or more.

Additionally, the joint support unit according to claim 4 is characterized in that, in the joint support unit according to any one of claims 1 to 3, bending directions of the first link and the second link is switched according to a moving direction of the driver, on the basis of a stretched state of the first link and the second link.

Additionally, a walking support apparatus (S) according to claim 5 includes an upper leg wearing unit (5) worn from a knee joint of a leg to an upper leg portion (16), a lower leg wearing unit (10) worn from the knee joint to a lower leg portion (17), and a joint support unit (20) worn on the knee joint, the joint support unit including a first link coupled to the upper leg wearing unit, a second link worn on the lower leg wearing unit, and a driving unit configured to cause the first link and the second link to perform rotational movement between the first link and the second link, or to relatively perform rotational movement while moving a rotation center and to perform sliding movement, the driving unit including a periphery cam, a driver configured to move around a periphery of the periphery cam, a first cam groove formed inside the periphery cam, a second cam groove arranged inside the first cam groove, and formed asymmetrically to the first cam groove, a first cam pin engaging with the first cam groove, and a second cam pin engaging with the second cam groove, wherein at least the first cam pin or the second cam pin is moved while being engaged with the first cam groove or the second cam groove by movement of the driver.

Advantageous Effects of Invention

A movement approximated to the movement of an actual knee joint can be realized. Additionally, since the bending directions can be switched, it can be worn on both left and right legs.

BRIEF DESCRIPTION OF DRAWINGS

FIG. 1(*a*) shows a state where a leg is stretched; and FIG. 1(*b*) shows a state where the leg is bent.

DESCRIPTION OF EMBODIMENTS

Hereinafter, an embodiment of the present invention will be described with reference to the drawings. Note that, in the following description, a description will be given of a walking support apparatus in which a joint support unit is used for a knee joint of a user. Additionally, in the following description, a "bending motion" refers to a motion of bending a knee joint, and a "stretching motion" refers to a motion of stretching the knee joint.

Figure 1:
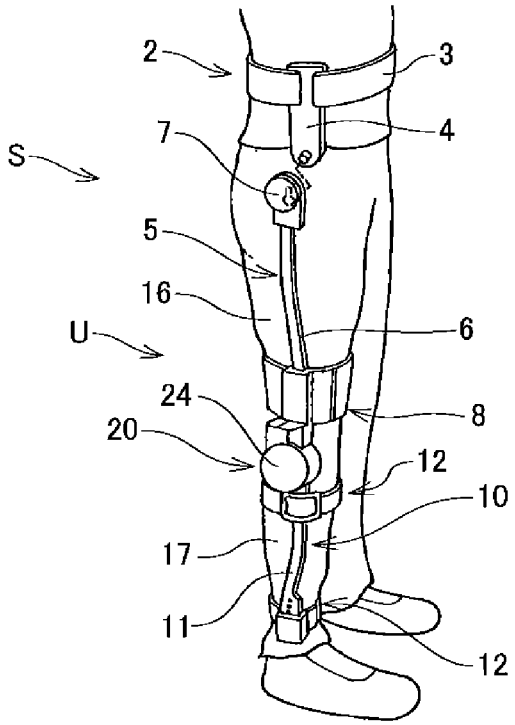
FIG. 1 is a schematic diagram showing usage sates of a walking support apparatus.
Figure 1:
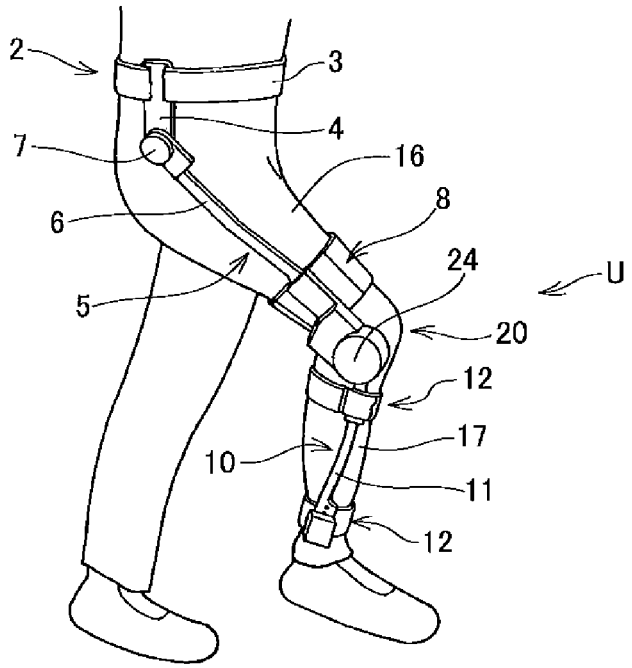

As shown in FIG. 1, a walking support apparatus S of the present embodiment is worn on a leg of the user, and includes a walking support unit U capable of being worn on both left and right legs. This walking support unit U includes an upper leg wearing unit 5 worn from a knee joint to an upper leg portion 16 of a leg, a lower leg wearing unit 10 worn from the knee joint to a lower leg portion 17, and a joint support unit 20 worn on the knee joint. Note that the walking support apparatus S is used by being coupled to, for example, a waist wearing unit 2 worn around the waist of the user, and in a case where support for both legs are required, the walking support unit U is worn on each of the left and right legs.

This walking support unit U performs walking support by causing the user to appropriately perform, for example, a stretching motion shown in FIG. 1(*a*), and a bending motion shown in FIG. 1(*b*), by oscillating the lower leg wearing unit 10 in the front and back directions with respect to the upper leg wearing unit 5 by driving, for example, a motor as a power source.

The waist wearing unit 2 includes a waist belt 3 wound around and attached to the waist of the user, and a coupling tool 4 coupled to the upper leg wearing unit 5 is provided on the left and right of the waist belt 3.

The upper leg wearing unit 5 includes a plate-like upper leg portion plate 6 arranged on a side surface of the upper leg portion 16 of the user, a top end is rotatably coupled to the waist wearing unit 2 via a coupling tool 7, and the upper leg portion plate 6 is attached to rise along a lateral surface of the upper leg portion 16. Additionally, the upper leg portion plate 6 is provided with a contact member to be contacted to a part of the upper leg portion 16, and an attaching tool 8, such as a hook and loop fastener, for causing the contact member to stick to the upper leg portion 16, and the upper leg portion plate 6 is fixed and attached above a knee by this attaching tool B.

Additionally, the lower leg wearing unit 10 includes a plate-like lower leg portion plate 11 arranged on a side surface of the lower leg portion 17 of the user, a top end thereof is coupled to the upper leg portion plate 6 via the joint support unit 20, and the lower leg portion plate 11 is attached to hang down along a lateral surface of the lower leg portion 17. Further, the lower leg portion plate 11 is provided with a contact member to be contacted to a below knee portion and to an ankle, and an attaching tool 12, such as a hook and loop fastener, for causing the contact member to stick to the below knee portion and the ankle, and a bottom end of the lower leg portion plate 11 is fixed and attached to the below knee portion and the ankle by this attaching tool 12.

Figure 2:
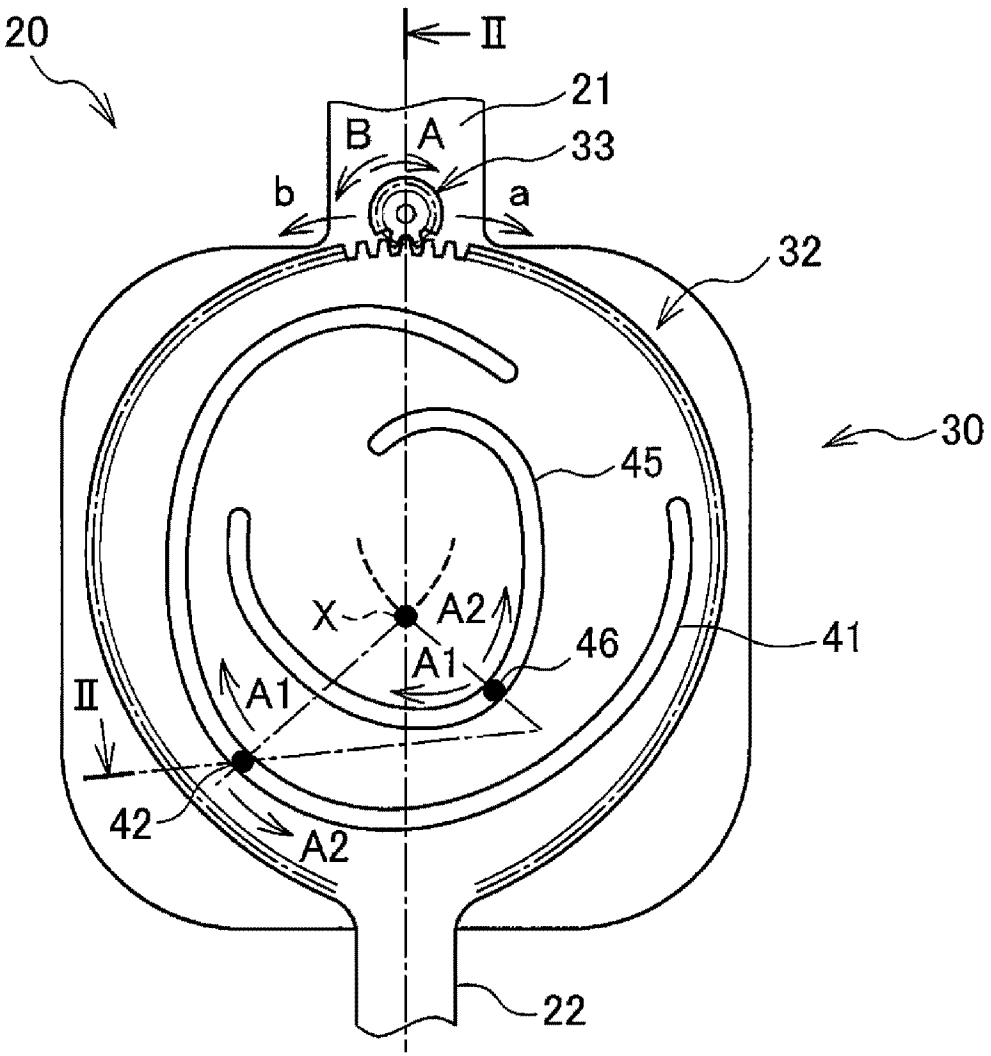
FIG. 2 is a schematic diagram showing the configuration of a joint support unit of the walking support apparatus.

As shown in FIG. 1 and FIG. 2, the joint support unit 20 includes a plate-like first link 21 that is arranged on the lateral surface of the knee joint of the user, and that is coupled to the upper leg portion plate 6, a plate-like second link 22 that is coupled to this first link 21 so as to be capable of being bent and stretched, and that is attached to the lower leg portion plate 11, and a driving unit 30 that causes the first link 21 and the second link 22 to perform rotational movement, or to perform relative rotational movement while moving a rotation center X and to perform sliding movement in the front and back directions.

The driving unit 30 includes a periphery cam 32, a driver 33 that moves on the periphery of the periphery cam 32 by rotation driving, a first cam groove 41 formed inside the periphery cam 32, a second cam groove 45 arranged inside the first cam groove 41, and formed asymmetrically to the first cam groove 41, a first cam pin 42 engaging with the first cam groove 41, and a second cam pin 46 engaging with the second cam groove 45. The driving unit 30 is covered with a cover 24, and the cover 24 can be attached to and removed from the first and second links 21 and 22.

In a periphery of the periphery cam 32, for example, a row of teeth to be engaged with the driver 33 is formed, a row of teeth is also formed in the outer peripheral edge of the driver 33, and the driver 33 moves on the periphery of the periphery cam 32 along the row of teeth by rotation of the driver 33, and at the same time, the periphery cam 32 is oscillated.

Figure 7:
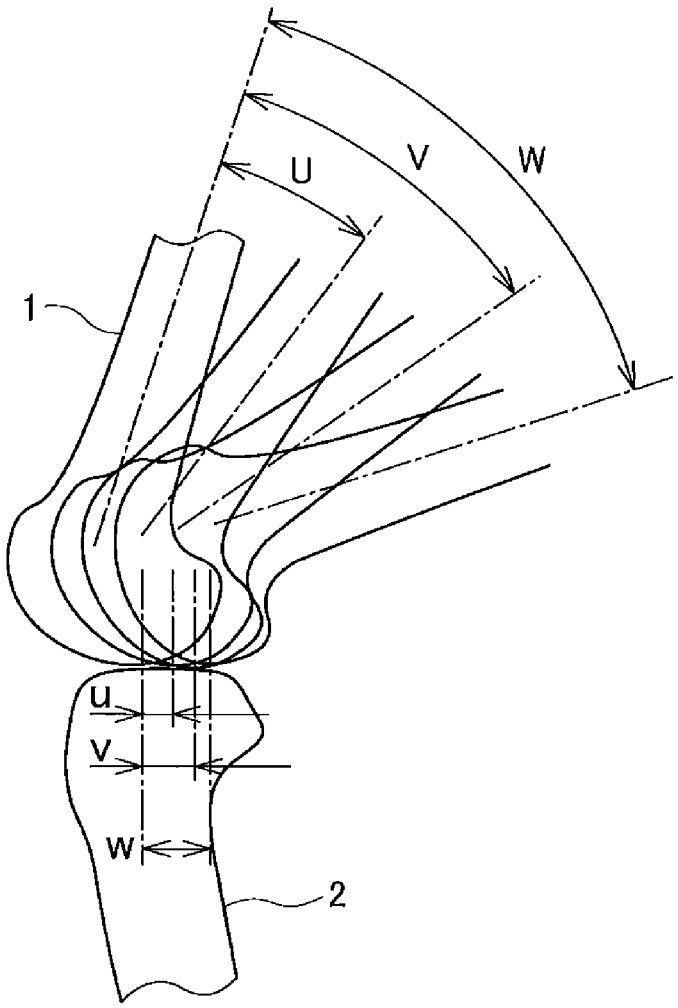
FIG. 7 is an explanatory diagram showing movement of the knee joint.
Figure 8:
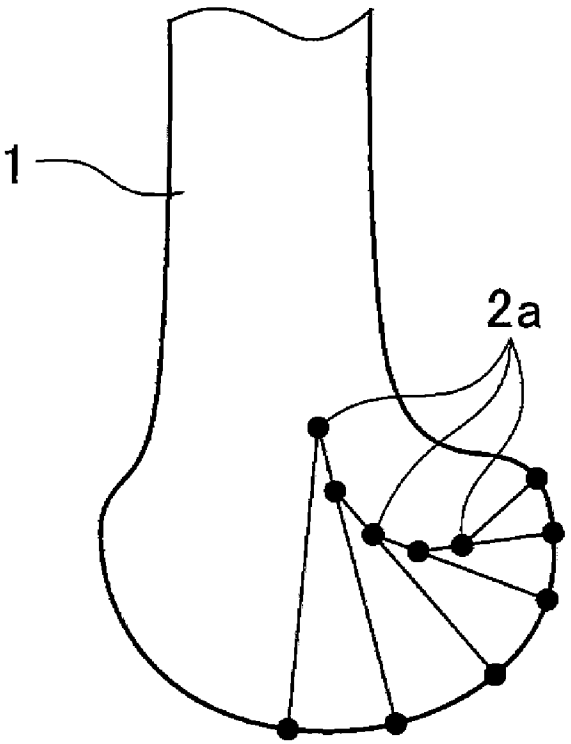
FIG. 8 is an explanatory diagram showing a situation where a rotation center of a lower portion of a femur is moved with bending of the knee joint.

Additionally, the outline of the periphery of the periphery cam 32 is formed into an arc shape having a predetermined curvature formed according to the movement of the rotation center X, and the outlines of the first and second cam grooves 41 and 45 are formed to generate the rotational movement or the sliding and rotating movement of the knee joint as a moving track of the knee joint shown in FIG. 7 and FIG. 8. That is, as shown in FIG. 7 and FIG. 8, since the actual knee joint performs a simple rotational movement without sliding from 0 degree at which a knee joint angle is straight to 15 degrees at which the knee joint begins to be bent, a portion corresponding to 0 to 15 degrees of the knee joint angle of the outlines of the first and second cam grooves 41 and 45 are formed into a perfect circle-like arc, since the knee joint performs rotating and sliding movement when the knee joint angle is between 15 degrees and 105 degrees, the outlines of the first and second cam grooves 41 and 45 are formed into an ellipse arc, and since the knee joint performs rotational movement again when the knee joint angle is 105 degrees or more, the outlines of the first and second cam grooves 41 and 45 are formed into a perfect circle-like arc. Accordingly, in the upper leg wearing unit 5 and the lower leg wearing unit 10, a movement approximated to the movement of the actual knee joint is realized.

Note that the outlines of the first and second cam grooves 41 and 45 are also formed to correspond to the operation in the opposite direction of the knee joint in a manner similar to the above-described manner.

Then, since the first cam groove 41 and the second cam groove 45 are formed so that the first cam pin 42 and the second cam pin 46 are movable to correspond to different driving directions generated between the first link 21 and the second link 22, on the basis of a stretched state of the first link 21 and the second link 22, and driving operations of the left and right legs can be performed, the joint support unit 20 can be used for both left and right legs.

Note that the shapes of the periphery cam 32 and the cam grooves 41 and 45 are properly changed according to the sizes of the first and second links 21 and 22, and the arrangement positions of the cam pins 42 and 46. Additionally, although the movement of a knee joint is different depending on the body shape, age, gender, etc., also in this case, the shapes of the periphery cam 32 and the cam grooves 41 and 45 may be changed.

Additionally, Since it is necessary for the first cam pin 42 and the second cam pin 46 to have resistance to each other when the first cam pin 42 or the second cam pin 46 is moved, each of the driver 33, the first cam pin 42, and the second cam pin 46 is arranged so as to be always maintained as a vertex forming a predetermined triangle.

Figure 4:
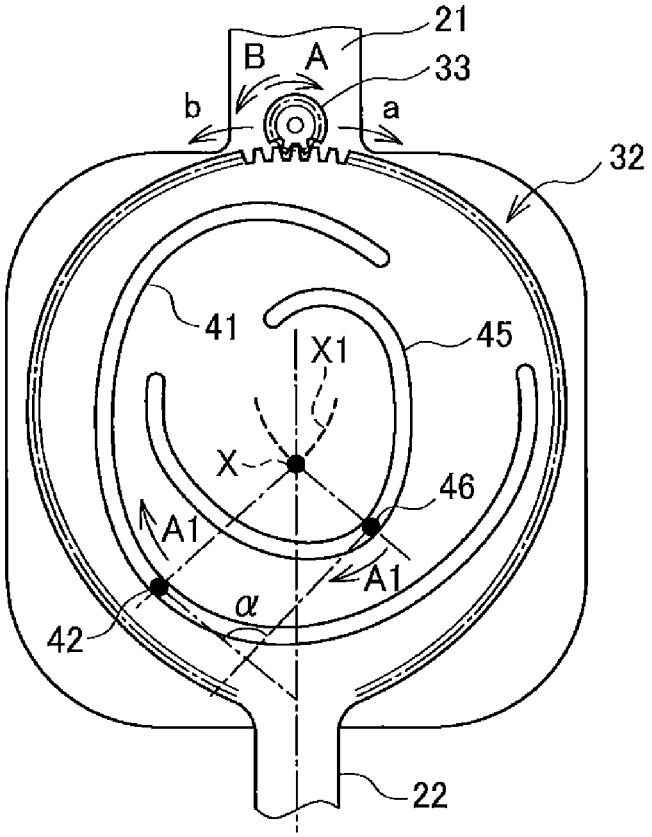
FIG. 4 is a schematic diagram showing an operation example of the joint support unit and showing a state where a knee joint is stretched.

Additionally, as shown in FIG. 4, the cam pins 42 and 46 arranged in the respective cam grooves 41 and 45 are arranged so that the internal angle (a) at which respective perpendicular lines perpendicularly crossing straight lines connecting the rotation center X and the respective cam pins 42 and 46 and passing through the respective cam pins 42 and 46 are crossed in a stretched state of the first link 21 and the second link 22 becomes at least 30 degree ($\pi/6$ rad) or more. By making this angle ($\alpha$) 30 degrees or more, it is possible to prevent the cam pins 42 and 46 from being corotated, or from being caught in the cam grooves 41 and 45 when the cam pins 42 and 46 are moved. Note that the upper limit value of this angle ($\alpha$) is preferably 150 degrees ($5/6\pi$ rad) or less for a good operation, but the range of this angle ($\alpha$) is properly changed according to the range of bending of a knee joint.

Additionally, the driver 33 and the first and second cam pins 42 and 46 are arranged so that the moving direction of each of the cam pins 42 and 46 and the direction of the bending motion of the first link 21 and the second link 22 are switched, according to the moving direction of driver 33, on the basis of the time when the first link 21 and the second link 22 are in the stretched state. Specifically, as shown in FIG. 2, by moving the driver 33 in a direction a in the stretched state of the first link 21 and the second link 22, the cam pins 42 and 46 can be moved in the cam grooves 41 and 45 in the direction of an arrow A1 in the figure, and by moving the driver 33 in a direction b, the cam pins 42 and 46 can be moved in the cam grooves 41 and 45 in the direction of an arrow A2 in the figure. Additionally, the direction of the bending motion of the first link 21 and the second link 22 is switched by this movement of the cam pins 42 and 46. In this manner, since the bending direction of a knee joint can be easily changed by switching the moving direction of the driver 33, it can be worn on both left and right legs, and the cost can be reduced.

In the driving unit 30 configured in this manner, as shown in FIG. 4 to FIG. 7, when the driver 33 is moved in the periphery of the periphery cam 32, the cam pins 42 and 46 are moved while being engaged with the respective cam grooves 41 and 45, the first link 21 and the second link 22 performs rotational movement between the first link 21 and the second link 22 or relative rotational movement while moving the rotation center X, and at the same time performs sliding motion in the front and back directions. The movement of the first link 21 and the second link 22 at this moment is approximated to the rotational movement or the sliding and rotating movement of the knee joint shown in FIG. 7, and the rotation center 2*a* in the lower portion of the femur 1 is moved to draw the curved track shown in FIG. 8.

Additionally, since the driving unit 30 can causes the first link 21 and the second link 22 to perform rotational movement, or to perform relative rotational movement while moving the rotation center X and to perform sliding movement in the front and back directions, by using a cam mechanism different from the cam mechanism that moves the cam pin according to the moving track of the rotation center X, as in the conventional knee joint movement support apparatus illustrated in Patent Literature 2, and further can switch the direction of the bending motion of the first link 21 and the second link 22 by moving the cam pins 42 and 46 from reference positions to the opposite directions to each other, the walking support unit U can be made to function for both left and right.

Figure 3:
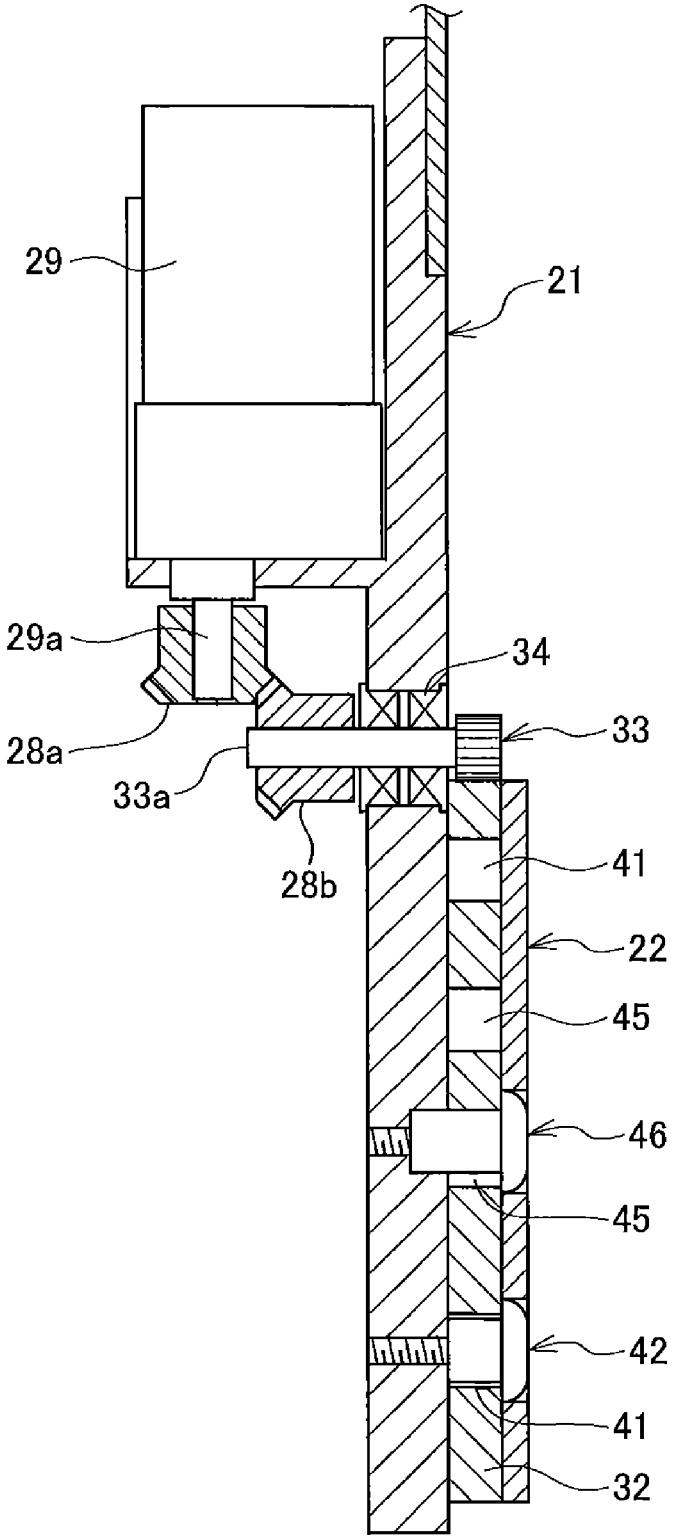
FIG. 3 is a schematic diagram showing a II-II cross section of FIG. 2.

Additionally, as shown in FIG. 3, the first link 21 and the second link 22 are arranged to be superimposed on each other, and a motor 29 as the power source of the driving unit 30 is attached to the first link 21 in a lengthwise orientation.

The driver 33 is arranged in the outer peripheral edge of the periphery cam 32, is rotatably and pivotally supported by the first link 21, protrudes to the second link 22 side, and is engaged with the row of teeth of the periphery cam 32. The cam pins 42 and 46 are attached to the first link 21 as freely rotatable rollers, protrude to the second link 22 side, and are engaged with the cam grooves 41 and 45. The driver 33 is formed as a pinion, and its shaft 33*a* is freely rotatably supported by the first link 21 via a bearing 34.

Additionally, a power transmission system from this motor 29 to the above-described driver 33 is also attached to this first link 21. The power transmission system is constituted by, for example, a train of gears consisting of a combination of a spur gear and a straight bevel gear, and a part of the train of gears is provided as a gear reducer that is not shown and that is in the motor 29. This gear reducer is constituted by, for example, a train of spur gears.

An shaft 29*a* of a termination gear of the gear reducer protrudes substantially perpendicularly downward from a casing of the motor 29, and the straight bevel gear 28*a* is fixed to a tip of the shaft 29*a*. This straight bevel gear 28*a* is engaged with another straight bevel gears 28*b*, and this straight bevel gear 28*b* is fixed to the shaft 33*a* of the above-described driver 33.

Accordingly, when the motor 29 is rotated, its power is transmitted to the driver 33, and the relative rotational movement and sliding motion as described above occurs to the first link 21 and the second link 22 therebetween. Additionally, since the power transmission system is constituted in this manner by the train of gears consisting of one or both of the spur gear and the straight bevel gear, even if a clutch, etc. is not provided, when there is an input from the human body side, the movement is not limited. Accordingly, since self-lock is avoided, and it is possible for a patient, etc. to not only freely move a leg at the time when the motor 29 is not working, but also move the leg so as to resist the motor 29 even in a case where the patient, etc. falls at the time when the motor 29 is working, it is very safe.

The above-described motor 29 is controlled by a control unit that is not shown, and is normally rotated or reversely rotated within a predetermined angular range of the above-described periphery cam 32.

Next, using FIG. 4 to FIG. 6, a description will be given of an operation example of the joint support unit 20 of the present embodiment.

Figure 5:
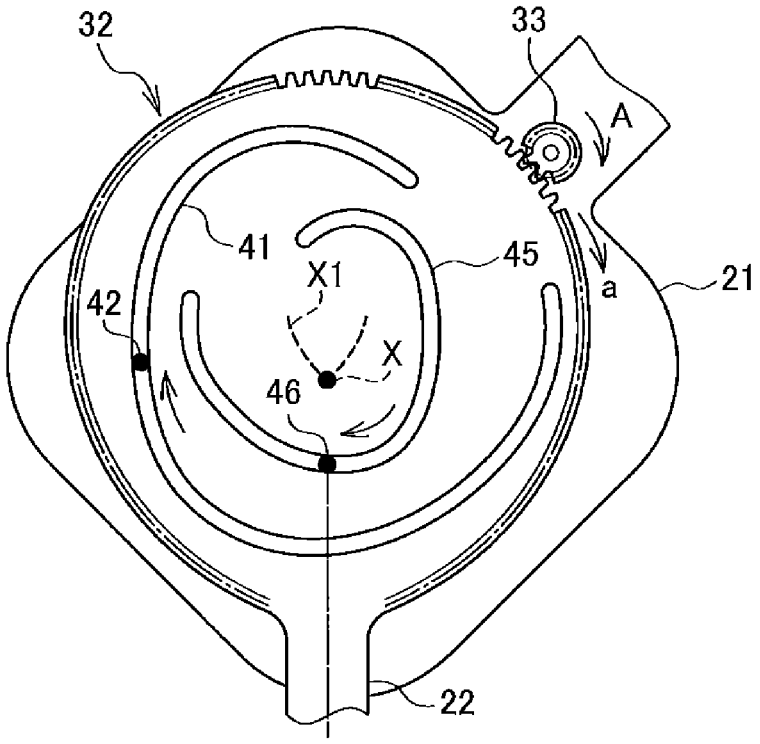
FIG. 5 is a schematic diagram showing an operation example of the joint support unit and showing a state where the knee joint is bent at the time of walking.
Figure 6:
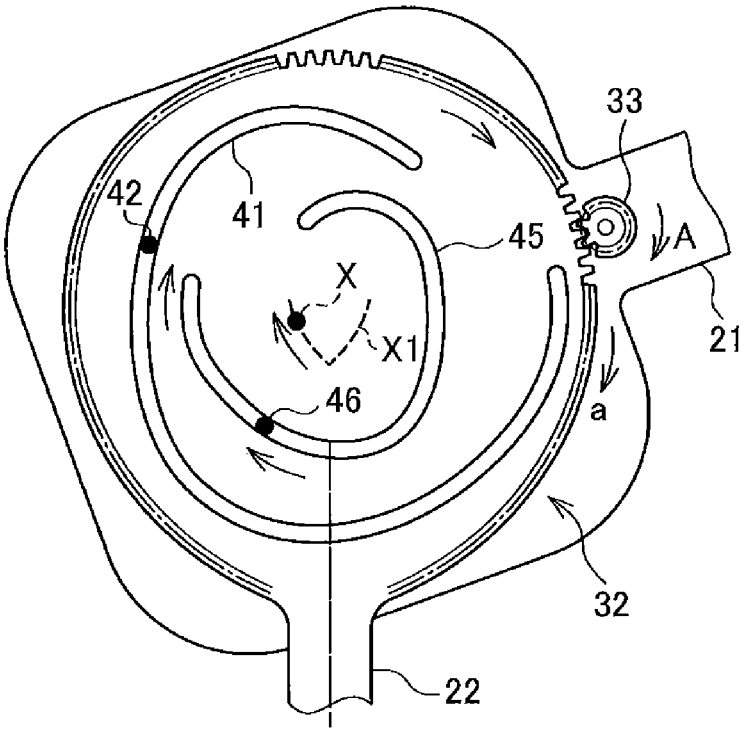
FIG. 6 is a schematic diagram showing an operation example of the joint support unit and showing a state where the knee joint is bent at the time of sitting.

For example, in a case where the user wearing the joint support unit 20 of the present embodiment is going to change the posture from a stand-up state shown in FIG. 4 to a bending state shown in FIG. 6 via an intermediate state shown in FIG. 5, as shown in FIG. 4, the driver 33 revolves in the direction of the arrow a around the periphery cam 32 while being rotated in the direction of the arrow A. Accordingly, the first link 21 and the second link 22 perform rotational movement or perform rotational movement with a different rotation center and perform sliding movement according to a predetermined rotation angle, to be bent, and it becomes possible for, for example, the upper leg portion 16 of the patient to be seated on a chair, etc.

Until the first link 21 is slightly bent from a state where the first link 21 extends straightly with respect to the second link 22 as shown in FIG. 4, although each of the cam pins 42 and 46 is moved in the A1 direction, the first link 21 and the second link 22 only perform rotational movement about the rotation center X, without performing sliding movement. This corresponds to 0 degree to 15 degrees of the knee joint angle, and the knee joint performs a simple rotational movement without sliding within this angular range.

Next, as shown in FIG. 5 and FIG. 6, when it is tried to further bend the first link 21 with respect to the second link 22, rotational movement is performed while performing sliding movement, as the rotation center X is moved diagonally to top left according to a virtual rotation center track X1 that shows the moving track of the rotation center at the time of movement of an actual knee joint. This corresponds to 15 degrees to 105 degrees of the knee joint angle. Accordingly, the first link 21 can be further bent about 90 degrees with respect to the second link 22 from the bending state shown in FIG. 6, and the patient can effortlessly sit down on a chair, etc.

Note that in a state immediately before the patient sits down, the motor 29 is rotated to the opposite direction by an instruction from the control unit that is not shown, and the knee joint is bent about 90 degrees with the patient's own weight, while bending of the knee joint is supported by controlling the driver 33 to apply a driving force in the opposite direction of the arrow A.

Thereafter, the motor 29 is reversely rotated by an instruction from the control unit that is not shown, and as sequentially shown in FIG. 6, FIG. 5 and FIG. 4, the driver 33 revolves the direction of an arrow b around the periphery cam 32 while being rotated in the direction of the arrow B. Accordingly, it becomes possible for the patient to stand up from the seated state.

Note that in a case where the driver 33 is caused to revolve in the arrow b direction around the periphery cam 32 while being rotated in the direction of the arrow B in the stretched state of the first link 21 and the second link 22, each of the cam pins 42 and 46 is moved to the opposite direction, the rotation center X is moved diagonally to top right, and is operated in a manner similar to the above.

Next, the effect of the walking support apparatus of the present embodiment will be described.

First, for example, as shown in FIG. 1(*a*), the walking support unit U of the walking support apparatus S is worn on a leg of a patient, etc. who had suffered from worsening knee osteoarthritis, and who had artificial knee joint replacement.

That is, the joint support unit 20 of the walking support unit U is applied to a lateral surface of a knee joint of the patient, the upper leg wearing unit 5 is applied to a side surface of the upper leg portion 16, and the lower leg wearing unit 10 is applied to a side surface of the lower leg portion 17.

Then, the coupling tool 7 of the upper leg wearing unit 5 is coupled to the coupling tool 4 of the waist belt 3 wound around the waist of the patient, the attaching tool 8 is attached to an above knee portion of the upper leg portion 16, and the attaching tool 12 is attached to a below knee portion of the lower leg portion 17 and an ankle.

In addition, although not shown, a battery is attached to the waist belt 3, and the motor 29 is electrically connected to this battery.

When an ON/OFF switch, which is not shown, of the motor 29 is turned on, the motor 29 is activated, and the power is input to the driver 33 via the train of gears of the driving unit 30.

The motor 29 is controlled by the control unit that is not shown in various kinds of control modes for walking, for seating, etc.

When set to the control mode for walking, the driver 33 starts to be rotated in the direction of the arrow A in a state where the knee joint is stretched as shown in FIG. 4, and revolves around the periphery cam 32 in the arrow a direction, and as a result, the upper leg wearing unit 5 and the lower leg wearing unit 10 perform relative rotational movement to cause the knee joint to be bent as shown in FIG. 5. The rotation angle of the knee joint by this rotational movement is, for example, within the range of 0 degree to 15 degrees.

Further, when the driver 33 is moved in the direction of the arrow a, the upper leg wearing unit 5 and the lower leg wearing unit 10 perform rotational movement while relatively performing sliding movement, as the rotation center X is moved diagonally to top left, and causes the knee joint to be bent as shown in FIG. 6. The rotation angle of the knee joint by this rotating and sliding movement is, for example, within the range of 15 degrees to 60 degrees.

In this manner, since the upper leg wearing unit 5 and the lower leg wearing unit 10 perform rotational movement while relatively performing sliding movement, as the rotation center X is moving diagonally to top left, the upper leg wearing unit 5 and the lower leg wearing unit 10 perform a movement approximated to the sliding and rotating movement of the knee joint of the human body shown in FIG. 7, and the patient can effortlessly and naturally bend a leg.

When the driver 33 revolves around the periphery cam 32 in the arrow a direction only by a predetermined angle, the motor 29 is switched to reverse rotation, the driver 33 starts to be rotated in the direction of the arrow B, and revolves around the periphery cam 32 in the arrow b direction, and as a result, the upper leg wearing unit 5 and the lower leg wearing unit 10 are relatively operated in the order of FIG. 6, FIG. 5 and FIG. 4 to stretch the knee joint.

Accordingly, since the upper leg wearing unit 5 and the lower leg wearing unit 10 perform rotational movement while relatively performing sliding movement, as the rotation center X is moved diagonally downward, the upper leg wearing unit 5 and the lower leg wearing unit 10 perform a movement approximated to the sliding and rotating movement of the knee joint of the human body shown in FIG. 7, and the patient can effortlessly and naturally stretch the leg.

Thereafter, by repeating normal rotation and reverse rotation of the motor 29, the rotation of the above-described driver 33 is alternately switched to the direction of the arrow A and the direction of the arrow B, stretching and bending of the upper leg wearing unit 5 and the lower leg wearing unit 10 are repeated, and the patient's walking operation is supported as shown in FIG. 1(A) and FIG. 1(B).

On the other hand, in a case where the motor 29 is set to the control mode for seating by the control unit that is not shown, the driver 33 starts to be rotated in the direction of the arrow A in a state where the knee joint is stretched as shown in FIG. 4, and revolves in the arrow a direction around the periphery cam 32, and as a result, the upper leg wearing unit 5 and the lower leg wearing unit 10 perform relative rotational movement or rotating and sliding movement, and cause the knee joint to be bent through the states of FIG. 5 and FIG. 6. The rotation angle of the knee joint in this rotational movement is, for example, within the range of 0 degree to 90 degrees.

Note that the driver 33 revolves around the periphery cam 32 only by a predetermined angle in the arrow a direction before a state where the patient sits down, thereafter reversely revolves around the periphery cam 32 in the arrow b direction to apply a driving force in the opposite direction, so as to support bending of the knee joint, thereafter, when the rotation angle of the knee joint is in the bending state of 90 degrees with the patient's own weight, the motor 29 is stopped, the relative rotational movement of the upper leg wearing unit 5 and the lower leg wearing unit 10 is also stopped, and it becomes possible for the patient to sit down on a chair, etc.

Note that the present invention is not limited to the above-described embodiment, and various changes can be made within the scope of the gist of the present invention. For example, the driver 33 and the periphery of the periphery cam 32 are configured to be engaged with each other via the row of teeth, but they are not particularly limited to this configuration. Additionally, although the motor is used as the driving source, it is also possible to use driving sources of other kinds.

REFERENCE SIGNS LIST

S . . . walking support apparatus, 20 . . . joint support unit, 21 . . . first link, 22 . . . second link, 30 . . . driving unit, 32 . . . periphery cam, 33 . . . driver, 41, 45 . . . cam groove, 42, 46 . . . cam pin

The invention claimed is:

1. A joint support unit comprising:
a first link worn on one end side of a knee joint;
a second link worn on the other end side of the knee joint; and
a driving unit configured to cause the first link to perform rotational movement with respect to the second link,
wherein the rotational movement has a rotation angular range in which the rotational movement is performed without moving a rotation center, and
a rotation angular range in which the rotational movement is performed while moving the rotation center,
the driving unit including:
a periphery cam;
a driver configured to move around a periphery of the periphery cam;
a first cam groove formed inside the periphery cam;
a second cam groove arranged inside the first cam groove, and formed asymmetrically to the first cam groove;
a first cam pin engaging with the first cam groove; and
a second cam pin engaging with the second cam groove,
wherein at least the first cam pin or the second cam pin is moved while being engaged with the first cam groove or the second cam groove by movement of the driver.

2. The joint support unit according to claim 1, wherein, in the first cam groove and the second cam groove, the first cam pin and the second cam pin are movable to correspond to different driving directions generated between the first link and the second link, on the basis of a stretched state of the first link and the second link.

3. The joint support unit according to claim 1, wherein an internal angle at which respective perpendicular lines perpendicularly crossing straight lines connecting the rotation center and the respective two cam pins, and passing through the respective cam pins are crossed in a stretched state of the first link and the second link is at least 30 degree or more.

4. The joint support unit according to claim 1, wherein bending directions of the first link and the second link is switched according to a moving direction of the driver, on the basis of a stretched state of the first link and the second link.

5. The joint support unit according to claim 2, wherein an internal angle at which respective perpendicular lines perpendicularly crossing straight lines connecting the rotation center and the respective two cam pins, and passing through the respective cam pins are crossed in a stretched state of the first link and the second link is at least 30 degree or more.

6. The joint support unit according to claim 2, wherein bending directions of the first link and the second link is switched according to a moving direction of the driver, on the basis of a stretched state of the first link and the second link.

7. The joint support unit according to claim 3, wherein bending directions of the first link and the second link is switched according to a moving direction of the driver, on the basis of a stretched state of the first link and the second link.

8. The joint support unit according to claim 5, wherein bending directions of the first link and the second link is switched according to a moving direction of the driver, on the basis of a stretched state of the first link and the second link.

9. A walking support apparatus comprising:

an upper leg wearing unit worn from a knee joint of a leg to an upper leg portion; a lower leg wearing unit worn from the knee joint to a lower leg portion; and a joint support unit worn on the knee joint, the joint support unit including:

a first link coupled to the upper leg wearing unit;

a second link worn on the lower leg wearing unit; and a driving unit configured to cause the first link to perform rotational movement with respect to the second link, wherein the rotational movement has a rotation angular range in which the rotational movement is performed without moving a rotation center, and a rotation angular range in which the rotational movement is performed while moving the rotation center, the driving unit including:

a periphery cam;

a driver configured to move around a periphery of the periphery cam;

a first cam groove formed inside the periphery cam;

a second cam groove arranged inside the first cam groove, and formed asymmetrically to the first cam groove;

a first cam pin engaging with the first cam groove; and a second cam pin engaging with the second cam groove, wherein at least the first cam pin or the second cam pin is moved while being engaged with the first cam groove or the second cam groove by movement of the driver.

* * * * *